United States Patent [19]

Grosse-Benne et al.

[11] 4,327,642

[45] May 4, 1982

[54] INSERTS FOR CUTTING CHARGES

[75] Inventors: Wilhelm Grosse-Benne; Paul Beermann, both of Menden, Fed. Rep. of Germany

[73] Assignee: Diehl GmbH & Co., Nuremberg, Fed. Rep. of Germany

[21] Appl. No.: 116,003

[22] Filed: Jan. 28, 1980

[30] Foreign Application Priority Data

Feb. 3, 1979 [DE] Fed. Rep. of Germany ..... 2904155

[51] Int. Cl.[3] ..... F42B 1/02

[52] U.S. Cl. ..... 102/307; 102/308

[58] Field of Search ..... 102/24 HC, 56 SC, 306, 102/308

[56] References Cited

U.S. PATENT DOCUMENTS

| | | | |
|---|---|---|---|
| 2,758,543 | 8/1956 | Grandin . | |
| 3,712,221 | 1/1973 | Voigt, Jr. et al. | 102/24 HC |
| 3,732,816 | 5/1973 | Müller | 102/24 HC |
| 3,732,818 | 5/1973 | Thomanek | 102/24 HC |
| 3,750,582 | 8/1973 | Kintish et al. | 102/24 X |
| 3,948,181 | 4/1976 | Bergstrom | 102/24 X |
| 3,976,010 | 8/1976 | Zernow | 102/24 X |
| 4,170,940 | 10/1979 | Precoul | 102/56 SC |

FOREIGN PATENT DOCUMENTS

| | | | |
|---|---|---|---|
| 1571283 | 5/1969 | Fed. Rep. of Germany | 102/24 HC |

OTHER PUBLICATIONS

Chou et al., *Criteria for Jet Formation from Impinging Shells & Plates,* J. App. Physics, vol. 47, #7, Jul. 1976, pp. 2975–2981.

*Primary Examiner*—Peter A. Nelson

*Attorney, Agent, or Firm*—Scully, Scott, Murphy & Presser

[57] ABSTRACT

Inserts for cutting charges utilized for the shearing or separation of steel plates, cables, bridge girders or the like. The cutting charges are provided with a hollow space in which there are adhered liners or inserts of multi-component structure so as to develope a primary detonating effect in a symmetrical plane. For military purposes the cutting charges have gabled roof-shaped or semicircular inserts, preferably of inert material or metal, such as electrolytic copper.

1 Claim, 10 Drawing Figures

INSERTS FOR CUTTING CHARGES

BACKGROUND OF THE INVENTION

1. Field of the Invention

The present invention relates to inserts for cutting charges which are utilized for the shearing of steel plates, cables, bridge girders and the like.

The cutting charges serve, for instance, for the shearing of steel plates, cables and bridge supports or girders and, in essence, cutting charges are even-symmetrical hollow charges. The cutting charges are provided with a hollow space which will develop its primary effect in the symmetrical plane. For military purposes there are primarily utilized cutting charges with gable or roof-shaped or semi-circular inserts.

Cutting charges are lined or clad hollow charges in which the liner is formed by an insert constituted of an inert material or of metal, preferably copper.

The liner serves as an energy transmitter since it concentrates the energy of the explosive charge on a small effective cross-section on the blasting object over a relatively lengthy period of time.

Through the detonation of the explosive charge the liner, in essence the insert, is so deformed that the liner material will flow together in the plane of symmetry, and from the collapsing point (the respective impact point of the liner elements) there will form itself the spine of high kinetic energy and the prop of low kinetic energy. The high kinetic energy spine is responsible for the effect in the blasted object.

These actions can be readily described through the intermediary of the hydrodynamic theory.

Important influencing parameters of the cutting charge with insert are the detonation velocity and the density of the explosive material, the shape of the detonation wave, as well as liner configuration and construction of the wall thickness of the liner, and the surface properties of the liner.

Pursuant to the hydrodynamic theory, the detonation pressure in the wave front is equal to the product of the density, detonation velocity and the explosive gas velocity, or the explosive gas velocity intensifies with the detonation velocity approximate proportional to the square of the detonation velocity.

In the explosive materials of a cutting charge chemical energy is converted into kinetic energy for which there are employed so-called brisant or high-energy explosive materials, such as trinitrotoluol, hexogen, octogen, and the like. Moreover, there are frequently utilized explosive materials which are admixed with metal powder; with the molecular disintegration of those type of explosive materials taking place within microseconds.

A damming of the explosive material is not necessary since the pressure wave will not expand as rapidly as the action of the molecular disintegration. The still undecomposed portion of the cutting charge will thus remain uninfluenced. The density of the explosive material is increased within the shock front.

The transformation front which propagates at supersonic speed within the explosive material is, in accordance with the chemical composition of the explosive material, between 6,000 to 9,000 m/sec., is followed by a zone of increasing pressure inasmuch as the rarefaction waves which emanate from the free surface of the cutting charge cannot follow as rapidly and the pressure is only gradually reduced behind the shock wave. In this manner are there achieved shock wave amplitudes of a few 100 kbar.

It is important, from the standpoint of blasting technology, when considering cutting depths through the effect of the cutting charge, that initially the explosive material evinces during casting a maximum densification, and the insert is so configured that there will be produced an effective cutting depth, which will only be the case when no residues of insert remain seated in the cut after the effectuated detonation.

Intensive investigations have disclosed that the cutting depth of a member which is subjected to shock waves is, in a first instance, determined by the velocity of the impact. Already at velocities which are located between 2 to 3 km/sec., with an increasing velocity the influence proceeds always more in favor of the density, since the occurring pressures far exceed the strength. The strength however, still has a predetermined degree of influence. When the velocity, however, exceeds the speed of sound such as, for example, for brisant or high-energy explosive materials at about 8 km/sec., then the tensile strength of the material which is to be sheared no longer plays a role, since the materials will then behave themselves as liquids.

The recognition of this importance is identified in the hydrodynamic theory as wave detonation steering.

2. Discussion of the Prior Art

In the known military cutting charges the liner consists either of sintered or copper material in a unitary or single-piece form. For inserts of copper there is utilized electrolytic copper having a high degree of purity. The inserts consist of copper sheets which are produced by a rolling process and thereafter, in accordance with need, are shaped in a bending or pressing process into either roof-shaped or semicircularly shaped inserts.

For cutting charges having roof-shaped inserts there is present a critical angle below which no spine formation will occur. This angle formation depends upon the compressibility of the insert material and the speed of sound therein. When the spine impacts against a target material, it is then deflected under the influence of the impact pressure. The achieved cutting depth hereby depends upon the charge and the shape of the space, the geometry and the composition of the lining, and the spacing of the charge and the kind of target. The occurences at the impact are rapidly moving particles against matter require a multi-dimensional treatment of the shock wave propagation and, presently, are just not accessible to a mathematical solution.

Consequently, at this time it is mostly still unknown at which aggregate condition the energy spine or also the hit target material will find itself during the blasting.

It can only be said with assurance that the cut dimensions, such as the depth and width, have no connection with the composition of the material of the target. The depth of the cut is essentially dependent only upon the insert and upon the strength of the charge.

The stamped or otherwise formed gabled roof-shaped or semicircular-shaped cutting charges must be produced during manufacture with the greatest degree of care and high precision. Fissures and notches adversely influence the cutting effect. In addition thereto, experiments have determined that the apex of the insert after the effectuated detonation remains seated to an extent as a solid copper component within the cut. For this reason it can be said with a degree of probability bordering on assuredness, that the apex of the insert, relative to a length of about 1 to 2 cm., acts as a jamming element during the detonation.

It is known that, when the shape and thickness of the metal insert, the explosive material coating and the optimum distance to the target do not stand in any particular relationship, it is impossible to achieve an optimum cut depth. Upon the detonation of the cutting charge, the metal insert is to a predetermined extent twisted outwardly, such as a hat lining and fires as an energy spine with the detonation velocity as the reference velocity of the system, multiplied by the flow velocity of the energy spine against the target object. The portion of the metal insert associated with the explosive gas side flows after the collision in the plane of the symmetry in the opposite direction and extends, i.e. as viewed from the considered overall system, with the speed which is reduced by the flow velocity slowly behind the high energy spine.

When the insert after its inversion in the apex is now not fully disintegrated, the cutting passageway is plugged at its end by the energy spine.

In addition to the inachievable optimum cutting power output for a single-piece insert, as previously mentioned, the production of that type of insert is expensive and complex.

SUMMARY OF THE INVENTION

Accordingly, it is an object of the present invention to provide for an improvement in the shearing power output of cutting charges and for the simplification of their manufacture, and for the inexpensive production of a precisely exact insert in which, subsequent to effected detonation, no residues of the insert will be present in the cut and wherein, finally the inserts can be produced precisely and commercially inexpensive. Furthermore these metal inserts can also be rapidly and precisely assembled in the cutting charge housings.

Also this is of particular importance inasmuch as due to the cutting depths which are to be attained, there can also be utilized prepressed or precast explosive material inserts of high density, and which can be homogeneously adhered with the metal insert.

Accordingly it is a more specific object of the present invention to provide inserts for cutting charges for the separation or shearing of steel plates, cables, bridge supports or girders and the like, in which the inserts are constituted of at least of two parts and are pressed, rolled or drawn into suitable shape and evidence suitable profiles.

The advantages which are achieved by the present invention consists of in particular in that the cutting power output is substantially increased, no residue components of the inserts will remain seated in the cut after the detonation, the insert can be produced precisely and exact, can be manufactured inexpensively and simply, and comfortably built into the cutting charge housing.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
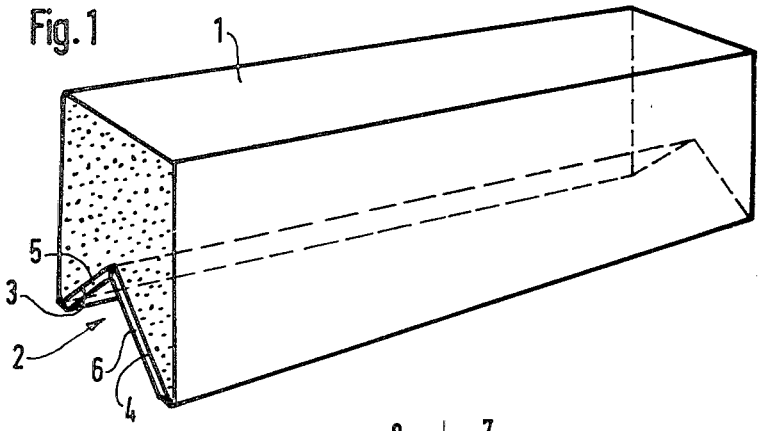
FIG. 1 illustrates a perspective view of a cutting charge with a gabled roof-shaped insert.
Figure 2:
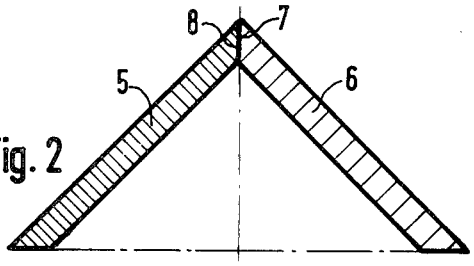
FIG. 2 is a cross-sectional view through a roof-shaped insert.
Figure 3:
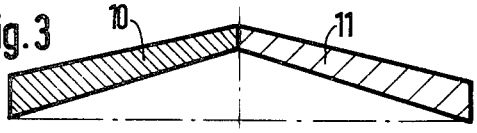
FIG. 3 is a cross-section through a roof-shaped insert having a progressively increasing thickness towards the opposite ends thereof.
Figure 4:
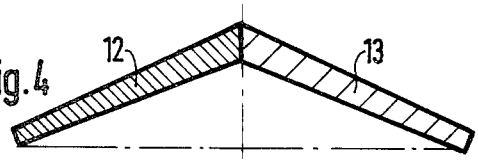
FIG. 4 is a cross-section through a roof-shaped insert having a progressively decreasing thickness towards the opposite ends thereof.
Figure 5:
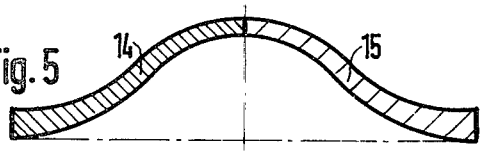
FIG. 5 is a cross-section through an insert in the shape of a sinusoidal wave.

Pursuant to FIGS. 1 and 2 of the drawings, an explosive charge unit 1 is provided with a recess 2 to whose surfaces 3, 4 there are adhesively fastened plate-like inserts 5, 6. The inserts 5, 6 consist of electrolytic copper. On the gable side thereof they contact each other with the surfaces 7, 8.

Other insert configurations with different material thicknesses are illustrated by the inserts 10 through 17 in accordance with FIGS. 3 through 5 and 8.

Figure 6:
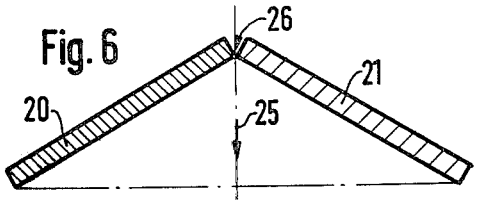
FIG. 6 is a cross-section through a roof-shaped insert open at its apex.
Figure 7:
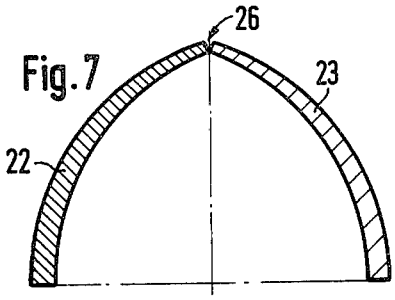
FIG. 7 is a cross-section through an ogive-shaped insert.
Figure 8:
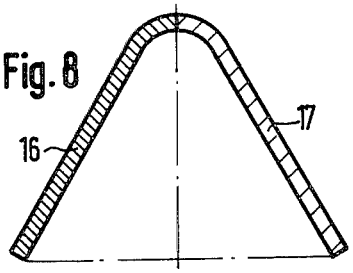
FIG. 8 is a cross-section through an insert which is roof-shaped and rounded-off at its apex.

Pursuant to FIGS. 6 and 7, located between the inserts 20–23 in an expansion joint 26 which is closed in the cut direction 25.

Figure 9:
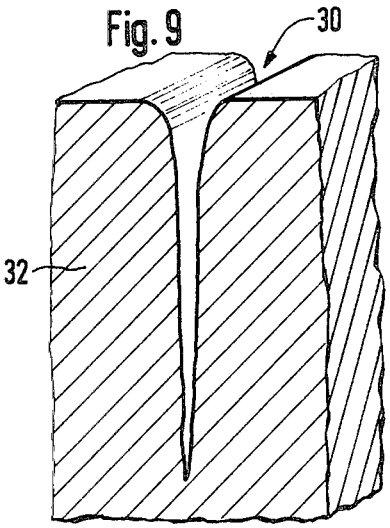
FIG. 9 represents a target block with an optimum cut.
Figure 10:
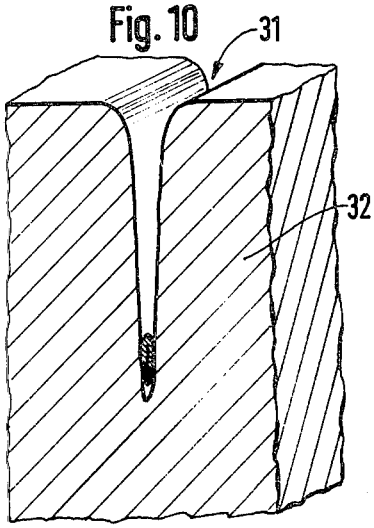
FIG. 10 represents a target block with insert residues in the cut.

A cut 30 pursuant to FIG. 9 which can be achieved by means of the hereinabove described inserts with an explosive material charge and the not herein described housing with a detonator arrangement, illustrates the power increase which is achievable in contrast with a cut 31 in a target block 32 pursuant to FIG. 10 achievable in accordance with the current state of the technology.

The principle of the invention can be summarized in that in lieu of the heretofore single-piece constructed insert, for the first time there are utilized separate inserts to be shaped into suitable form wherein a high degree of effectiveness is reached at the cutting depth.

Through the above-described type of the inserts for cutting charges there is produced a lining which technically conforms to the present recognition of hollow charge and cutting charge research and, moreover, can be produced simply and inexpensively.

We claim:

1. An apparatus for the cutting or shearing of man-made structural members, the improvement comprising an insert having at least two parts, said parts forming a gablesided expansion joint, said joint being fully closed in the cut direction.

* * * * *